US005241919A

United States Patent [19]

LaGreca

[11] Patent Number: 5,241,919

[45] Date of Patent: Sep. 7, 1993

[54] APPLIQUE INCLUDING CHENILLE, BACKING, POLYMER FILM, AND STITCHING

[75] Inventor: Richard LaGreca, Branford, Conn.

[73] Assignee: Chenille Concepts, Inc., Branford, Conn.

[21] Appl. No.: 874,744

[22] Filed: Apr. 27, 1992

[51] Int. Cl.[5] ..... D05C 17/02; B32B 7/08; A41D 27/08

[52] U.S. Cl. ..... 112/410; 112/439; 112/441; 112/266.1; 2/244; 2/246

[58] Field of Search ..... 112/402, 403, 406, 409, 112/410, 412, 418, 429, 431, 439, 441, 262.1, 266.1, 266.2; 2/243 A, 244, 246; 28/143, 144, 145, 153, 159, 160, 163; 156/91, 93

[56] References Cited

U.S. PATENT DOCUMENTS

| | | | |
|---|---|---|---|
| 301,485 | 7/1884 | Maesener | 112/410 X |
| 359,142 | 3/1887 | Pechtman | 112/439 X |
| 656,559 | 8/1900 | Marsh | 112/402 X |
| 889,614 | 6/1908 | Johnsen | 112/439 X |
| 924,795 | 6/1909 | Klemm et al. | 28/164 |
| 1,682,474 | 8/1928 | Bergman | 112/439 |
| 1,748,608 | 2/1930 | Kokatnur | 28/166 |
| 1,855,003 | 4/1932 | Snarck | 112/403 X |
| 2,155,212 | 4/1939 | Zenorini | 112/403 |
| 2,365,315 | 12/1944 | Williams | 28/168 X |
| 3,040,332 | 6/1962 | Kleinwald | 112/439 |
| 4,103,634 | 8/1978 | Schachter | 112/439 |
| 4,140,563 | 2/1979 | Sternaker | 28/164 X |
| 4,427,472 | 1/1984 | Trager | 112/402 X |
| 4,517,910 | 5/1985 | Jalowsky | 2/244 X |
| 4,646,666 | 3/1987 | Burrier | 112/441 X |
| 5,003,674 | 4/1991 | Cohen et al. | 28/109 |
| 5,005,219 | 4/1991 | Diaz | 112/439 |

FOREIGN PATENT DOCUMENTS

| | | | |
|---|---|---|---|
| 2748130 | 5/1978 | Fed. Rep. of Germany | 112/418 |

OTHER PUBLICATIONS

SOLVY, Gunold & Stickma, 1989.

*Primary Examiner*—Clifford D. Crowder
*Assistant Examiner*—Ismael Izaguirre
*Attorney, Agent, or Firm*—DeLio & Peterson

[57] ABSTRACT

An applique design is produced on a garment or other fabric article by providing chenille material having a fabric base and a plurality of cut or looped threads extending from an upper surface of a fabric base and applying a flexible backing material to a lower surface of the chenille material. The chenille material is cut to form edges having an outline of a desired design and disposed over a garment or fabric base. A polymer film is overlaid on the upper surface of the chenille material and a design is stitched over the film to the chenille material and the garment or fabric base, the stitching comprising closely spaced thread which covers and compresses portions of the film and chenille material, the film providing a barrier layer to prevent the thread loops from extending between the closely spaced thread of the stitching. The film is removed from unstitched portions of the upper surface of the chenille material whereby the desired design is formed by the stitched and unstitched portions of the chenille material.

19 Claims, 3 Drawing Sheets

APPLIQUE INCLUDING CHENILLE, BACKING, POLYMER FILM, AND STITCHING

BACKGROUND OF THE INVENTION

1. Field of the Invention

This invention relates to appliques using high nap fabrics and, in particular, to designs made from appliques of chenille material.

2. Background Information

Chenille material, which has a high nap, carpet-like surface, has long been used for design purposes on garments such as jackets or other fabric bases. As used herein, "chenille" material refers to any high nap fabric in which threads or fibers comprising the nap extend above a flexible woven or non-woven base. The threads or fibers may comprise loops or cut ends to provide a plush, carpet-like surface. Typically, a raised stitch, commonly called a Moss stitch, is used to produce the chenille material In the past, designs made from chenille material have been time consuming and difficult to produce and affix to the garment or fabric base. Generally, the chenille design was produced by Moss stitching the desired final design directly upon a felt base. Either the felt base was used as the final garment or fabric base, or the felt was thereafter cut out around the stitched design and sewn to the final garment or fabric base. In other instances the chenille design was made by Moss stitching the final design on a felt base which had already been cut to the desired outline. These methods are highly labor intensive and inefficient in production. U.S. Pat. Nos. 359,142, 4,103,634 and 5,005,219 are examples of known methods of producing chenille designs. In the method exemplified by U.S. Pat. No. 4,103,634, crest forms have been Cut from a block of pre-made chenille material and then bound to a felt base by stitching. While this has some advantages over other prior art methods, the felt base extends outside of the stitched edges of the chenille crest and provides an additional design element which must be utilized when applying the final product to a garment or other fabric base. Furthermore, while the felt backing has some flexibility, it adds an additional degree of stiffness when finally applied to the garment. This also results in an additional stitching step since the chenille material must be stitched both to the felt backing and later when the crest is sewn onto the garment or fabric base.

Bearing in mind the problems and deficiencies of the prior art, it is therefore an object of the present invention to provide an applique which utilizes mass produced chenille material.

It is another object of the present invention to provide an applique made of chenille material which minimizes the labor required to manufacture and affix the applique to a garment or fabric base.

It is a further object of the present invention to provide an applique made of chenille material which is soft and flexible and does not impart unnecessary stiffness to the garment or fabric base.

SUMMARY OF THE INVENTION

The above and other objects, which will be apparent to those skilled in the art, are achieved in the present invention which relates in a first aspect to a method of manufacturing an applique by first obtaining chenille material having a flexible backing material affixed thereto. The backing material is preferably a soft polymeric layer comprising a vinyl compound. The chenille material has a plurality of cut or looped threads extending from an upper surface of a fabric base opposite the backing material, and edges of the chenille material form the outline of a design. A polymer or other type film, such as a water soluble polymer film, is then overlaid on the upper surface of the chenille material and a design is stitched over the film to the chenille material and backing material. The stitching comprises closely spaced thread which covers portions of the film and chenille material, and preferably substantially all edges of the chenille and backing material. Finally, the film is removed from the unstitched portions of the upper surface of the chenille material.

In a preferred embodiment, the process for producing an applique article having a design thereon comprises the steps of:

providing chenille material having a fabric base and a plurality of cut or looped threads extending from an upper surface of a fabric base;

applying and securing a flexible backing material to a lower surface of the chenille material opposite the upper surface;

cutting the chenille material to form edges having an outline of a desired design;

disposing the cut chenille material over a garment or fabric base;

overlaying a polymer film on the upper surface of the chenille material;

stitching a design over the film to the chenille material and the garment or fabric base, the stitching comprising closely spaced thread which covers and compresses portions of the film and chenille material, the film providing a barrier layer to prevent the thread loops from extending between the closely spaced thread of the stitching; and removing the film from unstitched portions of the upper surface of the chenille material whereby the desired design is formed by the stitched and unstitched portions of the chenille material.

The polymeric backing material may be applied in an uncured state to the chenille material and cured thereon, or may be applied in a cured state and secured to the chenille material by an adhesive or by a combination of heat and/or pressure.

In another aspect, the invention relates to an applique article comprising chenille material cut to form the outline of a desired design which has a flexible backing material affixed and secured to substantially the entire lower surface of the chenille material. Stitching is affixed to the chenille material and the backing material which comprises closely spaced thread forming a design which covers portions of an upper surface of the chenille material A film layer is disposed between the stitching and the upper surface of the chenille material providing a barrier layer to prevent the cut or looped threads from extending between the closely spaced thread of the stitching.

In a preferred embodiment, the invention relates to a garment or fabric article having an applique thereon comprising chenille material having a plurality of cut or looped threads extending from an upper surface of a fabric base, cut edges in the outline of a desired design, and a flexible polymeric backing material affixed to a lower surface of the chenille material. A garment or fabric base underlies the chenille and backing material, and stitching affixes the chenille and backing material to the garment or fabric base. The stitching comprises closely spaced thread covering and compressing portions of the upper surface of the chenille material and forms a desired design by contrast between stitched and unstitched portions of the chenille material. A polymeric film layer is disposed between the stitching and the upper surface of the chenille material providing at least a temporary barrier layer during production of the garment or fabric to prevent the thread loops from extending between the closely spaced thread of the stitching. Preferably, the stitching covers all edges of the chenille material. The backing material may comprise a vinyl compound and the film may be a polymer film such as a water soluble polymer film.

DESCRIPTION OF THE PREFERRED EMBODIMENTS

The chenille material used in the present invention may be made of any conventional woven or non-woven fabric base and high nap cut or looped thread pile. Natural or synthetic materials may be utilized such as cotton, nylon, rayon, acrylic, or other fibers made of natural or synthetic polymers. The chenille material may be made in mass quantities on machines of the type used to make carpeting which apply cut or looped threads which extend from an upper surface of a fabric base. A common Moss stitch is normally applied, although other well-known methods of producing plush, high nap fabrics may also be utilized. The preferred chenille material is made on a woven fabric base and utilizes looped acrylic thread.

Once a desired quantity of chenille material is obtained, normally in the form of a length of such material wound in a roll, a soft, flexible backing is applied to the lower surface of the chenille material, opposite the cut or looped thread surface. While a woven or non-woven fabric such as felt may be applied, it is preferred that the backing material be a layer of a polymeric material having a thickness of about 0.003"(0.0762 mm).

In the case of a preformed backing layer, such as a cured polymer, the backing layer may be applied to the lower surface of the chenille material by an adhesive or by the application of heat and/or pressure to secure it firmly. Alternatively, the polymeric layer may be applied in an uncured state by conventional processes to the surface of the chenille material opposite the cut or looped threads by conventional means such as continuous roller applied techniques. The polymer may then be cured in-situ on the chenille material by air drying, heat, or radiation techniques, depending upon the polymer utilized. While it has been found that latex foams or coatings provide a suitable backing material, it is preferred that the backing be of a softer texture such as those provided by vinyl compounds, such as extruded vinyl film having a weight of about 2.46 oz./sq. yd. (3.52 g/sq.m) polymer backings such as silicone foam, may be utilized. It is important that the backing material be attached to the underside of the chenille material base at substantially the entire interface.

Figure 1:
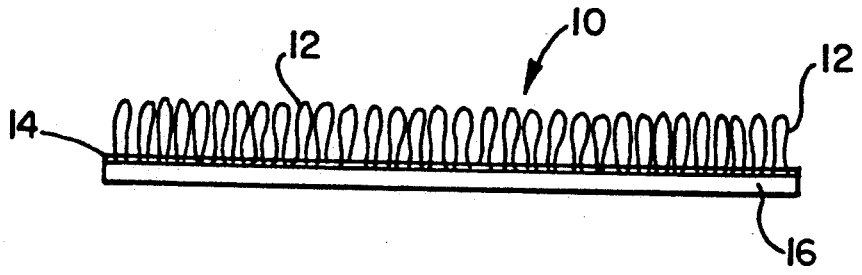
FIG. 1 is a cross-sectional view of the preferred chenille material of the present invention applied to a flexible backing layer.

Turning now to FIG. 1, there is shown the chenille material 10 composed of uncompressed acrylic thread loops 12. Moss stitched onto a backing such as a carpet binding 14. The looped threads 12 extend upward and provide a plush, carpet-like surface. On the underside of chenille material 10, there is provided a backing material 16 such as a latex or vinyl film which is laminated to the chenille material 10 by appropriate heat and pressure, e.g., 320° F. (160°) at 35 psi (0.24/nPa) for 10 seconds. The chenille material 10 with affixed backing 16 is provided in wide sheet or continuous roll form, according to the capabilities of the processing equipment.

Figure 2:
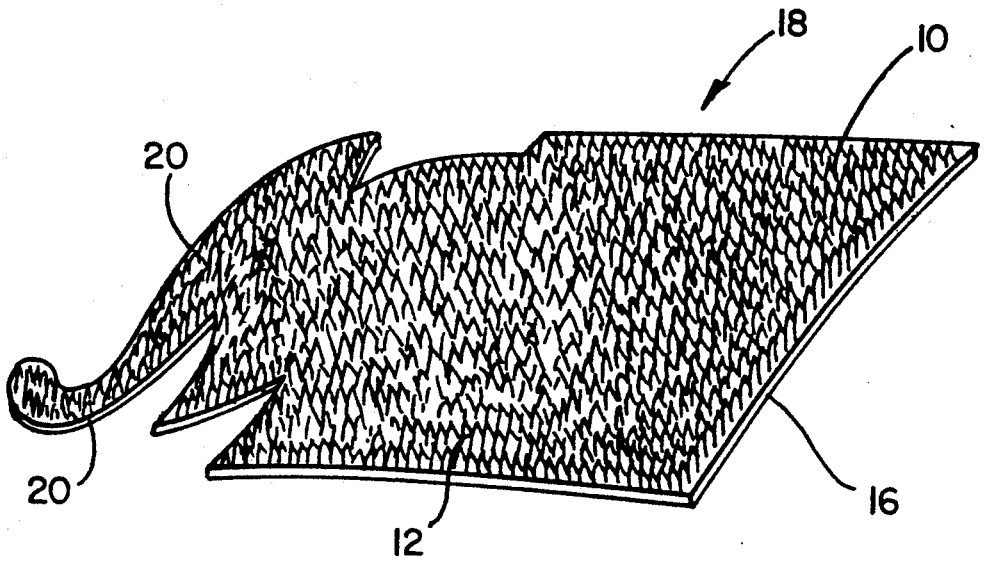
FIG. 2 is a perspective view of a mass produced chenille with affixed backing material partially cut-out to form the outlines of a desired design.

Following production of the chenille material having the backing material secured thereto, the outline of the desired design is produced by cutting the edges of the chenille/backing material by conventional die cutting methods. As shown in FIG. 2, the mass produced chenille/backing material 18 is cut along edges 20 to form a desired shape, the outline being of a script "M" in the particular embodiment shown. If necessary, the die cut edges 20 may be further trimmed by shears to cut off any extraneous fibers from the chenille material.

Figure 3:
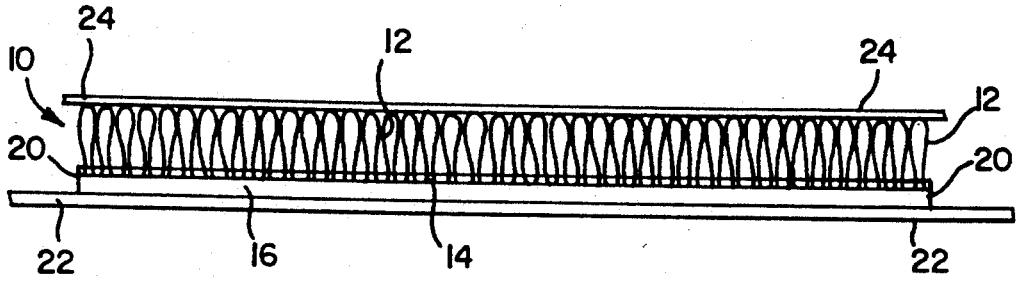
FIG. 3 is a cross-sectional view of the cut-out chenille with affixed backing material applied to a garment or fabric base and overlaid with a barrier film material.

Following cutting of the desired shape or outline of the final applique, the cut chenille/backing material is overlaid on a garment or fabric base 22 (FIG. 3), and a thin film such as a plastic or polymer 24 is overlaid on the upper surface of the chenille material 10. The polymeric film may be polyethylene or other plastic, or may be a water soluble plastic such as polyvinyl alcohol film as described in U.S. Pat. No. 2,365,315, the disclosure of which is incorporated by reference. Preferably, a water soluble plastic foil sold under the trademark "SOLVY" available from Gunold and Stickma of Atlanta, Ga.

Figure 4:
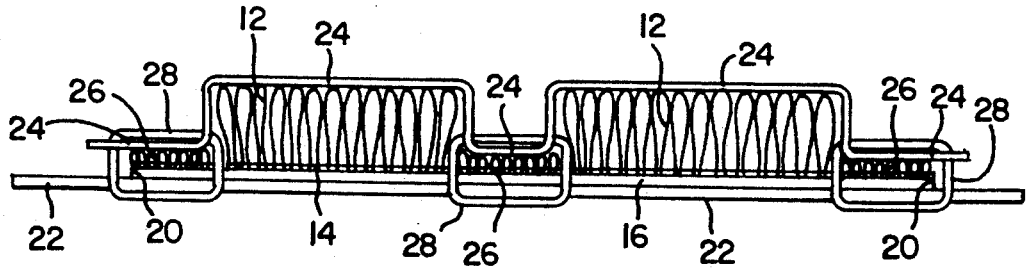
FIG. 4 is a cross-sectional view showing closely spaced stitching which covers portions of the film and chenille material and affixes the chenille and backing material to the base.

To outline the desired design and contrast with the cut or looped thread of the chenille material, and to secure the chenille/backing material to the garment or fabric backing 22, closely spaced satin cover stitches of 30–40 weight rayon thread are made around the edges and selected interior portions of the chenille/backing material. As shown in cross section in FIG. 4, the closely spaced stitches, which are preferably on the order of 65–70 thread stitches per inch, compress selected portions of the looped or cut threads 26. Film 24 is disposed between the stitching 28 and compressed thread 26 and provides a barrier layer during sewing to prevent the thread loops from extending between the stitching and being visible on the upper surface of the applique. During this process, the unstitched portions of the film 24 and chenille threads 12 remain uncompressed. It should be noted that in the present invention, preferably substantially all of the cut edges 20 of the chenille/backing material are covered by the closely spaced stitches 28 by securing the backing 16 directly to the chenille material before cutting the desired shape. As a result, the chenille/backing material is required to be stitched only once during the process, which results in the chenille applique being affixed directly to the desired final garment or fabric base. The closely spaced stitches 28 may be made by hand, or more preferably by a tape or microprocessor controlled automatic sewing machines in the desired pattern.

Figure 5:
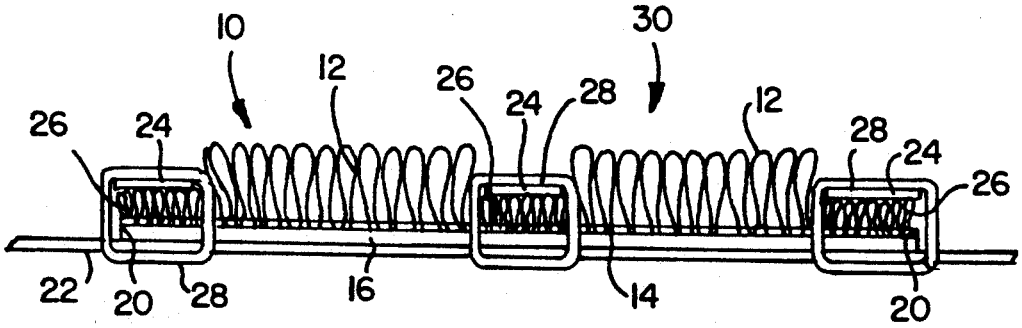
FIG. 5 is a cross sectional view similar to FIG. 4, except that the barrier film has been removed from unstitched areas of the chenille material.
Figure 6:
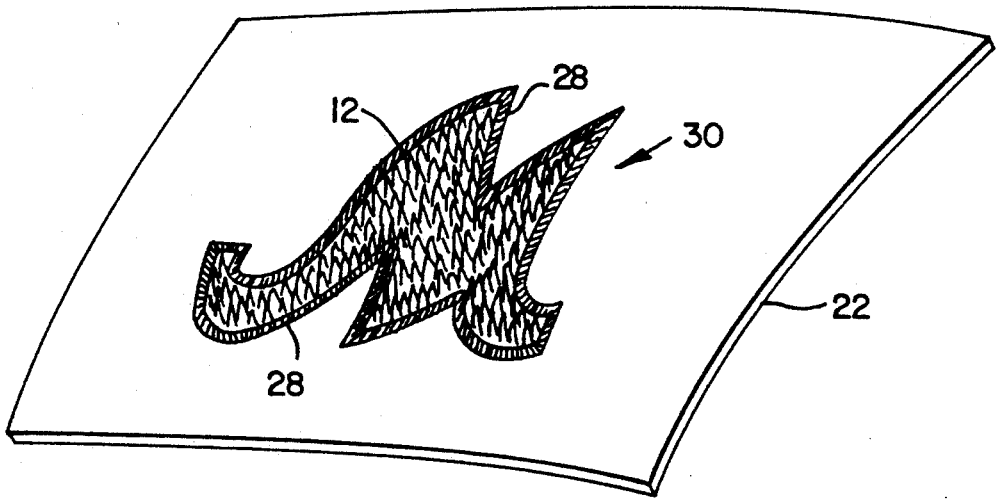
FIG. 6 is a perspective view of the completed applique of the present invention applied to a garment or fabric base.

As shown in the cross-sectional view in FIG. 5 and in the perspective view in FIG. 6, the film layer 24 is removed from the uncompressed, unstitched areas of the chenille material to expose the applique design. Where a water soluble film layer is employed, residual film may be removed by washing in water. The final design is provided by the contrast between the uncompressed thread 12 and the stitching 28, which may or may not be of the same color or type fibers. The finished applique 30 is thus provided directly upon the final garment or fabric base 22 in which the applique is to be utilized. Due to the unique structure of the applique in accordance with the present invention, no felt or other backing trim need be exposed around the stitched outline of the applique design.

Thus, unlike the prior art in which the chenille was produced by Moss stitching directly upon a felt backing in a desired design, and thereafter the falt cut-out around the stitched design, the present invention provides a preformed applique of a chenille material with affixed backing which may be cut out by mass production methods in the desired outline and then furnished to the clothing or fabric producer to be affixed directly on the final garment or fabric itself. This provides substantial savings in labor and provides more freedom in design with chenille material.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A method of manufacturing an applique article comprising:

a) providing chenille material having a flexible backing material affixed thereto, said chenille material having a plurality of cut or looped threads extending from an upper surface of a fabric base opposite said backing material forming an upper surface of the chenille material, edges of said chenille and backing material forming an outline of a first design;

b) overlaying a film on said upper surface of said chenille material;

c) stitching a second design over said film to said chenille material and backing material, said stitching comprising closely spaced thread which covers portions of said film and chenille material; and d) removing said film from unstitched portions of said upper surface of said chenille material whereby said applique article is formed by said stitched and unstitched portions of said chenille material.

2. The method of claim 1 further comprising after step (a), overlying said chenille material and backing material over a garment or fabric base, and wherein said stitching of step is additionally to said garment or fabric base.

3. The method of claim 1 wherein in step (c), said stitching of said second design covers substantially all edges of said chenille and backing material.

4. The method of claim 1 wherein said film is a polymer film.

5. The method of claim 1 wherein said film is a water soluble polymer film.

6. The method of claim 1 wherein said backing material is a layer of a vinyl compound.

7. A process for producing an applique article having a design thereon comprising:

a) providing chenille material having a fabric base and a plurality of cut or looped threads extending from an upper surface thereof forming an upper surface of the chenille material;

b) applying a flexible backing material to a lower surface of said chenille material opposite said upper surface;

c) cutting said chenille material to form edges having an outline of a first design;

d) disposing said cut chenille material over a garment or fabric base;

e) overlaying a polymer film on said upper surface of said chenille material;

f) stitching a second design over said film to said chenille material and said garment or fabric base, said stitching comprising closely spaced thread which covers and compresses portions of said film and chenille material, said film providing a barrier layer to prevent said thread loops from extending between the closely spaced thread of said stitching; and g) removing said film from unstitched portions of said upper surface of said chenille material whereby said applique article is formed by said stitched and unsubtituted portions of said chenille material.

8. The process of claim 7 wherein said backing material is a layer of a vinyl compound.

9. The process of claim 7 wherein said backing material is applied in an uncured state to said chenille material and is cured thereon.

10. The process of claim 7 wherein said backing material is applied in a cured state to said chenille material by an adhesive or by lamination.

11. The process of claim 7 wherein said film is a water soluble polymer film.

12. An applique article comprising:

chenille material having cut edges forming an outline of a first design;

a flexible backing material affixed to a lower surface of said chenille material;

stitching affixed to said chenille material and said backing material comprising closely spaced thread forming a second design which covers portions of an upper surface of said chenille material; and a film layer disposed between said stitching and said upper surface of said chenille material providing a barrier layer to prevent said thread loops from extending between the closely spaced thread of said stitching.

13. The article of claim 12 further comprising a garment or fabric base disposed under said chenille material and backing material and affixed thereto by said stitching.

14. The article of claim 12 wherein said stitching covers substantially all edges of said chenille and backing material.

15. The article of claim 12 wherein said film is a polymer film.

16. The article of claim 12 wherein said film is a water soluble polymer film.

17. The article of claim 12 wherein said backing material is a layer of a vinyl compound.

18. An article having an applique thereon comprising:

chenille material having a plurality of cut or looped threads extending from an upper surface of a fabric base forming an upper surface of the chenille material and cut edges in an outline of a first design;

a flexible polymeric backing material affixed to a lower surface of said chenille material;

a garment or fabric base underlying said chenille and backing material;

stitching affixing said chenille and backing material to said garment or fabric base comprising closely spaced thread covering and compressing portions of the upper surface of said chenille material and forming a second design by stitched and unstitched portions of said chenille material; and a polymeric film layer dispsoed between said stitching and said upper surface of said chenille material providing at least a temporary barrier layer during production of said garment or fabric to prevent said thread loops from extending between the closely spaced thread of said stitching.

19. The article of claim 18 wherein said backing material is a layer comprising a vinyl compound.

* * * * *

UNITED STATES PATENT AND TRADEMARK OFFICE

CERTIFICATE OF CORRECTION

PATENT NO. : 5,241,919

DATED : SEPTEMBER 7, 1993

INVENTOR(S) : RICHARD LaGRECA

It is certified that error appears in the above-identified patent and that said Letters Patent is hereby corrected as shown below:

Column 1, Line 36; delete "Cut" and insert -- cut --.

Column 4, Line 9; insert the word -- Other -- before the word polymer (starting a new sentence)

In Column 5, Line 24; delete "falt" and insert -- felt --.

Column 5, Line 67, insert -- (c) -- after the word "step."

Signed and Sealed this

Fifteenth Day of March, 1994

*Attest:*

*Attesting Officer*

BRUCE LEHMAN

*Commissioner of Patents and Trademarks*